US011225805B2

(12) United States Patent
Huang et al.

(10) Patent No.: US 11,225,805 B2
(45) Date of Patent: Jan. 18, 2022

(54) BRACKET FOR A FRAMED POOL ASSEMBLY AND A FRAMED POOL ASSEMBLY

(71) Applicant: BESTWAY INFLATABLES & MATERIAL CORP., Shanghai (CN)

(72) Inventors: Shuiyong Huang, Shanghai (CN); Xiaobo Chen, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 33 days.

(21) Appl. No.: 16/587,045

(22) Filed: Sep. 29, 2019

(65) Prior Publication Data

US 2020/0332544 A1 Oct. 22, 2020

(30) Foreign Application Priority Data

Apr. 19, 2019 (CN) ..... 201920537027.2

(51) Int. Cl.
*E04H 4/00* (2006.01)

(52) U.S. Cl.
CPC ..... *E04H 4/0056* (2013.01)

(58) Field of Classification Search
CPC ..... E04H 4/0056
USPC ..... 4/506
See application file for complete search history.

(56) References Cited

U.S. PATENT DOCUMENTS 4,356,933 A * 11/1982 Connolly ..... B65D 88/16 220/495.08
4,890,343 A * 1/1990 Schlags ..... A47K 3/286 220/62
5,083,327 A 1/1992 Gillebaard
D355,589 S * 2/1995 Kuwata ..... D8/382
6,477,721 B2 * 11/2002 Lee ..... E04H 4/0056 4/506
6,604,250 B1 8/2003 Lee
10,161,149 B2 * 12/2018 Liu ..... E04H 4/0056
(Continued)

FOREIGN PATENT DOCUMENTS

CN 208184307 12/2018
DE 8810857 10/1988
(Continued)

OTHER PUBLICATIONS

Extended European Search Report, dated Sep. 16, 2020 (Sep. 16, 2020) on related European Patent Application 20168860.3 by the European Patent Office.
(Continued)

*Primary Examiner* — Huyen D Le

(74) *Attorney, Agent, or Firm* — Dickinson Wright PLLC

(57) ABSTRACT

A bracket is delineated for supporting a pool liner to form a framed pool. The bracket comprises an upper frame including a plurality of first supporting tubes. A plurality of second supporting tubes couple to the upper frame for vertically supporting the upper frame. A plurality of connectors couple the plurality of first supporting tubes to one another to form the upper frame and also couple the plurality of second supporting tubes to the upper frame wherein each connector of the plurality of connectors is coupled to the first supporting tubes via a press-fit connection without using pins or other retention members. A framed pool including the bracket is also delineated herein.

27 Claims, 8 Drawing Sheets

(56) References Cited

U.S. PATENT DOCUMENTS

| | | | | |
|---|---|---|---|---|
| 10,246,891 | B2 * | 4/2019 | Huang | E04H 4/0056 |
| 2009/0205121 | A1 * | 8/2009 | Cheng | E04H 4/0056 4/506 |
| 2011/0056519 | A1 | 3/2011 | Card et al. | |

FOREIGN PATENT DOCUMENTS

| | | |
|---|---|---|
| DE | 19904335 | 8/1999 |
| EP | 3043008 | 7/2016 |

OTHER PUBLICATIONS

Extended European Search Report, dated Sep. 16, 2020 (Sep. 16, 2020) on related European Patent Application 20174053.7 by the European Patent Office.

Extended European Search Report, dated Sep. 16, 2020 (Sep. 16, 2020) on related European Patent Application 20174106.3 by the European Patent Office.

* cited by examiner

BRACKET FOR A FRAMED POOL ASSEMBLY AND A FRAMED POOL ASSEMBLY

CROSS REFERENCE TO RELATED APPLICATION

This application claims priority to Chinese Application Serial Number CN201920537027.2 filed on Apr. 19, 2019, the entire disclosure of which is incorporated herein by reference.

RELATED FIELD

The present invention relates to a bracket pool. In particular, the present disclosure relates to a pin-less bracket pool including a bracket and a flexible film pool liner.

BACKGROUND

Detachable household above-ground pools are very popular among consumers due to their convenient installation and storage. Common above-ground pools can be categorized into bracket pools with metal (or plastic) brackets and non-bracket pools without metal (or plastic) brackets. Tubes and connectors of existing bracket pool are generally fixed to each other by pins such that it is complex to install the bracket pool. And for a bracket pool with pins, when the pool is shaken, water can easily flow into the tubes through the pin joints, thereby corroding the pins, the connectors, and/or the tubes and negatively affect the service life of the bracket. Prior art references offer a solution of disposing a small waterproof cap to limit water flow. However, this solution results in the pool having a more complicated structure and a higher production cost. In addition, this solution creates more inconvenience for the installation process of the pool.

SUMMARY

The present invention overcomes the deficiencies mentioned above and solves the water seepage problem for the framed pools. The present invention provides a bracket for the framed pool which can be assembly without using any pins thereby reducing the number of fittings/components and the manufacturing costs of the framed pool. In addition, the present invention provides a bracket for the framed pool having reduced the installation steps which allow the bracket to be conveniently assembled and disassembled.

It is one aspect of the present invention to provide a bracket for supporting a pool liner to form a framed pool. The bracket comprises an upper frame including a plurality of first supporting tubes. A plurality of second supporting tubes couple to the upper frame for vertically supporting the upper frame. A plurality of connectors couple the plurality of first supporting tubes to one another to form the upper frame and also couple the plurality of second supporting tubes to the upper frame wherein each connector of the plurality of connectors is coupled to the first supporting tubes via a press-fit connection without using pins or other retention members.

It is another aspect of the present invention to provide a framed pool assembly comprising a bracket and a pool liner supported by the bracket. The bracket includes an upper frame including a plurality of first supporting tubes. A plurality of second supporting tubes couple to the upper frame for vertically supporting the upper frame. A plurality of connectors, each connector of the plurality of connectors having a T-shape, couple adjacent pairs of first supporting tubes to one another to form the upper frame and also couple the plurality of second supporting tubes to the upper frame wherein the plurality of first supporting tubes and the plurality of second supporting tubes are in sealing engagement with the plurality of connectors. The pool liner includes a pool wall having a lower edge and an upper edge and a pool bottom having a periphery. The lower edge of the pool wall and the periphery of the pool bottom connect to one another. A plurality of sleeves are located at the upper edge of the pool wall, spaced apart from one another, with each sleeve of the plurality of sleeves receiving a supporting tube of the plurality of first supporting tubes and having a connector of the plurality of connectors being exposed between adjacent sleeves of the plurality of sleeves. The pool wall has a perimeter less than or equal to a perimeter of the upper frame whereby, in response to filling the pool liner with water, weight of the water applies a force on the plurality of first supporting tubes via the plurality of sleeves, allowing each connector of the plurality of connectors to secure adjacent supporting tubes of the plurality of first supporting tubes to one another.

It is a further aspect of the present invention to provide a framed pool assembly. The framed pool assembly comprises a bracket and a pool liner supported by the bracket. The bracket includes an upper frame including a plurality of first supporting tubes. A plurality of second supporting tubes couple to said upper frame for vertically supporting the upper frame. A plurality of connectors couple the plurality of first supporting tubes to one another to form the upper frame and also couple the plurality of second supporting tubes to the upper frame. Each connector of the plurality of connectors is coupled to the first supporting tubes via a press-fit connection without using pins or other retention members. The pool liner includes a pool wall having a lower edge and an upper edge and a pool bottom having a periphery. The lower edge of the pool wall and the periphery of the pool bottom connect to one another. A plurality of sleeves are located at the upper edge of the pool wall, spaced apart from one another, with each sleeve of the plurality of sleeves receiving a supporting tube of the plurality of first supporting tubes and having a connector of the plurality of connectors being exposed between adjacent sleeves of the plurality of sleeves.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

Figure 1:
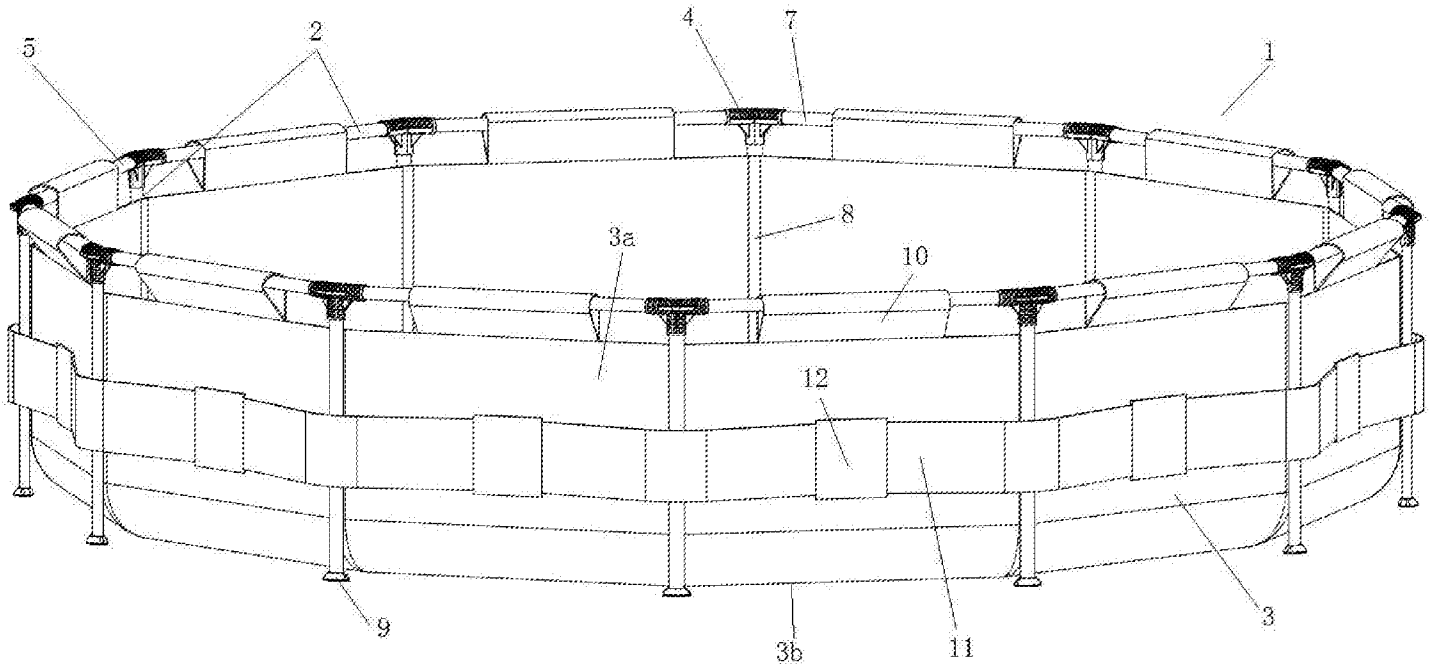
FIG. 1 is a perspective view of a framed pool assembly constructed according a first embodiment of the present invention.

Referring to the Figures, wherein like numerals indicate corresponding parts throughout the several views, a framed pool 1 constructed in accordance with one aspect of the present invention is generally shown in FIG. 1.

FIGS. 1-5 show a framed pool 1 according to a first embodiment of the present invention. The framed pool 1 includes a bracket 2 and a pool liner 3 for containing water. The bracket 2 provides support for the pool liner 3. The bracket 2 is formed by a plurality of steel tubes which are connected via T-shaped connectors 4. The pool liner 3 is typically made of a flexible film material. In another arrangement, the pool liner 3 can be made from a flexible reinforced Polyvinyl Chloride (PVC) material or Polyurethane (PU) material sandwiched with mesh cloth. Details of the bracket 2 and the pool liner 3 will be described below.

Figure 2:
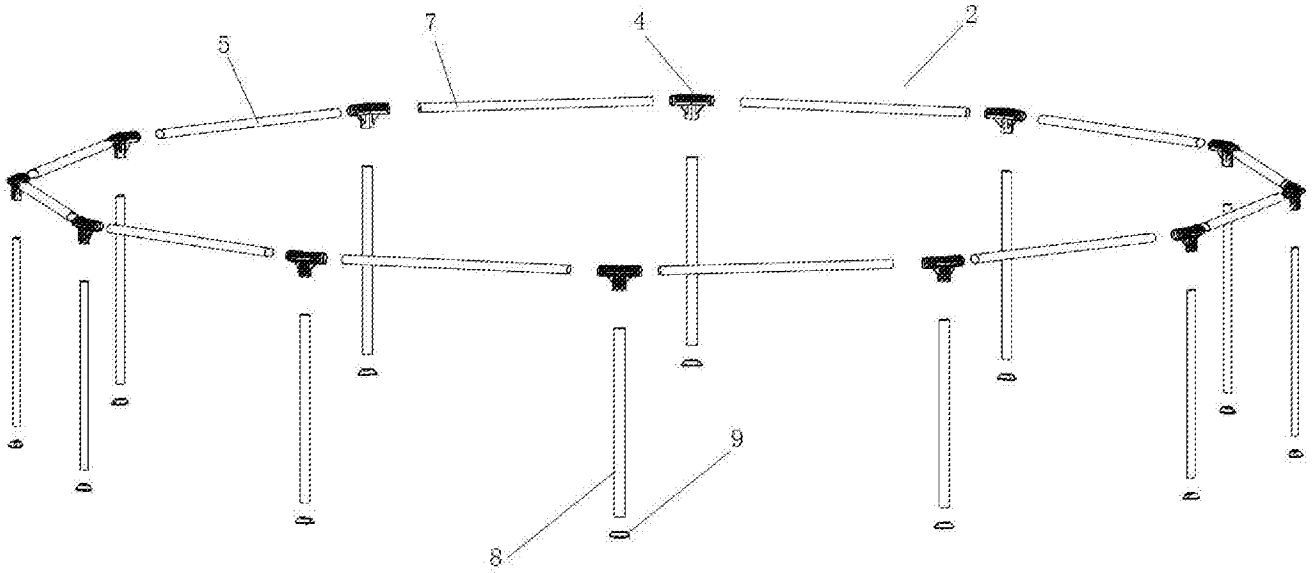
FIG. 2 is an exploded view of a bracket of the framed pool assembly.

FIG. 2 shows an exploded perspective view of the bracket 2. The bracket 2 includes an upper frame 5 having a generally circular shape, and a plurality of second supporting tubes 8 coupled to the upper frame 5 for vertically supporting the upper frame 5. The upper frame 5 is formed by connecting a plurality of first supporting tubes 7 in sequence in a circumferential manner. Each adjacent pair of first supporting tubes 7 and a second supporting tube 8 between the pair of adjacent first supporting tubes 7 are connected by a T-shaped connector 4. A pad 9 is provided at a lower end of each of the second supporting tubes 8 for stabilizing the support of the second supporting tube 8. According to one embodiment, the first supporting tubes 7 and the second supporting tubes 8 are steel tubes. However, it should be understood that the first supporting tubes 7 and the second supporting tubes 8 may also be made of other high-strength materials such as plastic. The T-shaped connectors 4 are made of plastic, but may also be made of other materials.

The pool liner 3 is disposed inside the bracket 2 and includes a pool wall 3*a* and a pool bottom 3*b*. The pool wall 3*a* has a lower edge and an upper edge. The pool bottom 3*b* has a periphery extending about the pool bottom 3*b*. The lower edge of the pool wall 3*a* and the periphery of the pool bottom 3*b* are connected to each other to form a container for receiving water. A plurality of sleeves 10 are located at the upper edge of the pool wall 3*a* with each sleeve 10 of the plurality of sleeves 10 receiving on a supporting tube of the plurality of first supporting tubes 7 and having a connector 4 of the plurality of connectors 4 being exposed between adjacent sleeves thereby attaching the upper portion of the pool liner 3 is to the upper frame 5. After water is injected into the pool liner 3, the pool wall 3*a* abuts against the plurality of second supporting tubes 8 and the bracket 2 supports the pool liner 3, defining a predetermined shape and position of the pool liner 3.

In the first embodiment, a reinforcing band 11 is provided and extending, annularly and continuously, about an outer surface of the pool wall 3*a* and the second supporting tubes 8. The reinforcing band 11 can surround the entire perimeter of the pool wall 3*a* or part of the perimeter of the pool wall 3*a*. A plurality of fixing patches 12, located about the outer surface of the pool wall 3*a* and circumferentially spaced from one another, are disposed over the reinforcing band 11 and attached to the outer surface of the pool wall 3*a*. It should be appreciated that various methods can be used to attach the fixing patches 12 to the outer surface of the pool wall 3*a*, such as but not limited to, high-frequency welding. In other words, the reinforcing band 11 passes through the fixing patches 12 and is fixed to and abuts against the outer surface of the pool wall 3*a* of the pool liner 3. This arrangement increases the strength of the pool liner 3, greatly reduces outward expansion deformation of the pool liner 3, and reduces or eliminates the force applied on the second supporting tubes 8 by the pool liner 3. In addition, the reinforcing band 11 is located outside the second supporting tubes 8, such that the reinforcing band 11 secures the second supporting tubes 8 in a predetermined position thereby preventing the second supporting tubes 8 from moving and defining a predetermined shape for the pool liner 3.

Figure 3:
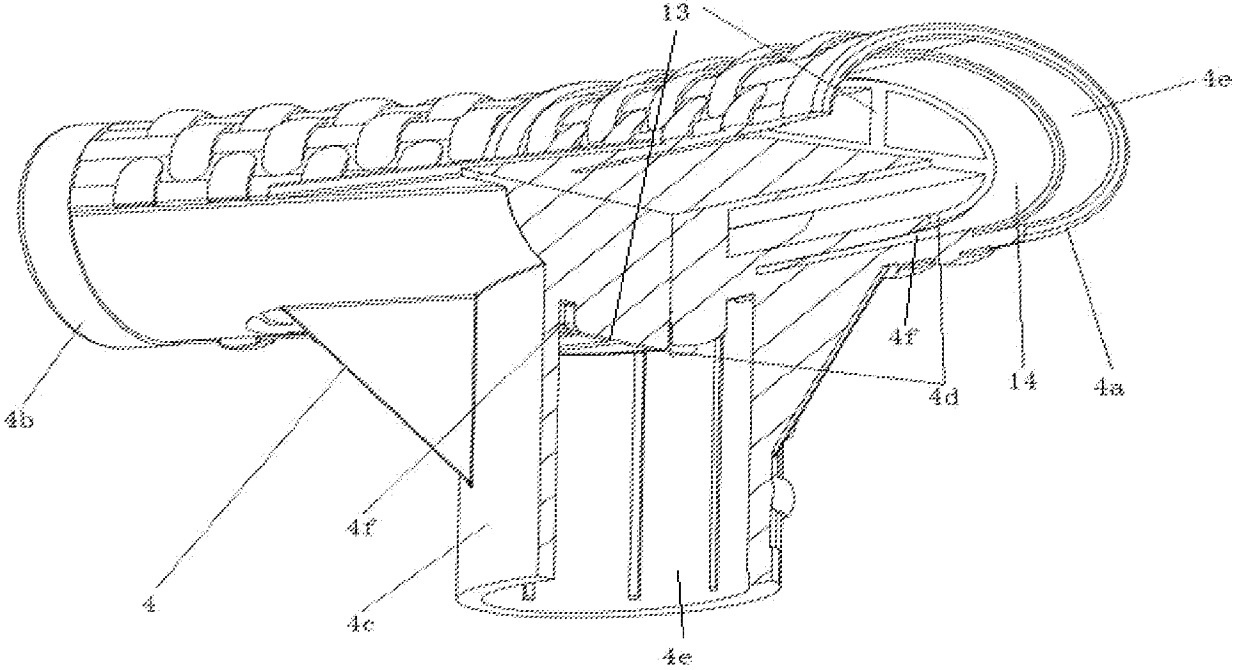
FIG. 3 is a sectional view of a connector of the bracket of FIG. 2.

FIG. 3 shows a sectional view of the T-shaped connector 4 according to the first embodiment of the present invention. The T-shaped connector 4 includes two first tubular parts 4*a*, 4*b* and a second tubular part 4*c*. The first tubular parts 4*a*, 4*b* are curved. The first tubular parts 4*a*, 4*b* are transverse to the second tubular part 4*c* to form the T-shape. A plurality of T-shaped connectors 4 sequentially couple adjacent first supporting tubes 7 via the first tubular parts 4*a*, 4*b* such that the plurality of first supporting tubes 7 are coupled to each other to form the upper frame 5 having an annular structure. The plurality of T-shaped connectors 4 are connected to the second supporting tubes 8 via the second tubular parts 4*c*, such that the plurality of second supporting tubes 8 collectively provide vertical support to the upper frame 5.

Each first supporting tube 7 connects to T-shaped connectors 4 in a manner that two ends 7*a*, 7*b* of the first supporting tube 7 are respectively inserted into the first tubular parts 4*a*, 4*b* of a T-shaped connectors 4. Each second supporting tube 8 connects to a T-shaped connector 4 in a manner that the upper end 8*a* of the second supporting tube 8 is inserted into the second tubular part 4*c* of the T-shaped connector 4. A protruding part 4*d* is located in at least one of the first tubular parts 4*a*, 4*b* and the second tubular part 4*c*. The protruding parts 4*d* are coaxial with the tubular parts 4*a*, 4*b*, 4*c* and protrudes outward in the horizontal direction with respect to tubular parts 4*a*, 4*b* and protrude outward in the vertical direction with respect to tubular part 4*c*. A protruding part 4*d* is spaced apart from an inner wall 4*e* of at least one of the first tubular parts 4*a*, 4*b*, whereby the protruding parts 4*d* and the inner wall 4*e* defines an annular space 4*f* extending therebetween. Another protruding part 4*d* is spaced apart from an inner wall 4*e* of the tubular part 4*c*, whereby the protruding part 4*d* and the inner wall 4*e* define an annular space 4*f* extending therebetween. During installation, the ends of each first supporting tube 7 are inserted into the annular space 4*f* within the first tubular parts 4*a*, 4*b*, and the upper end 8*a* of each second supporting tube 8 is inserted into the annular space 4*f* within the second tubular part 4*c*. The annular spaces 4*f* are designed such that the ends of each of the supporting tubes 7, 8 are press-fitted with a corresponding tubular part 4*a*, 4*b*, 4*c* to form a press-fit connection.

As best illustrated in FIG. 3, the protruding parts 4*d* of the tubular parts 4*a*, 4*b*, 4*c* each includes a cross-shaped reinforcing member 13 for increasing the strength of the protruding parts 4*d* and making the tubular parts 4*a*, 4*b*, 4*c* less susceptible to deformation. It should be understood that the reinforcing member 13 may also have other shapes. Additionally, the protruding part 4*d* may be constructed in the form of a tubular member, a solid bump, a combination thereof and the like that can define the annular space 4*f* together with the inner wall 4*e*.

In addition, the inner walls of the first tubular parts 4*a*, 4*b* each include at least one projection 14 extending from the inner wall 4*e* for engaging with a supporting tube 7 of the plurality of first supporting tubes 7 and forming the press-fit connection. The projection(s) 14 is spaced from and located outside the annular space 4*f*. When the first supporting tube 7 is inserted into the first tubular parts 4*a*, 4*b* of the T-shaped connectors 4, the outer wall of the first supporting tube 7 is interference-fitted or press-fitted with the projection(s) 14. Since the first supporting tubes 7 are close to the framed pool 1, when the framed pool 1 is shaken or agitated, the quality of connection between the first supporting tubes 7 and the connectors 4 are affected. Accordingly, water may easily flow into the first supporting tubes 7 through the joints of the first supporting tubes 7 and the connectors 4 thereby causing corrosion to the first supporting tubes 7. The projection(s) 14 can effectively prevent water from entering the first supporting tubes 7 through the joints and solve the problem of water seepage.

Figure 4:
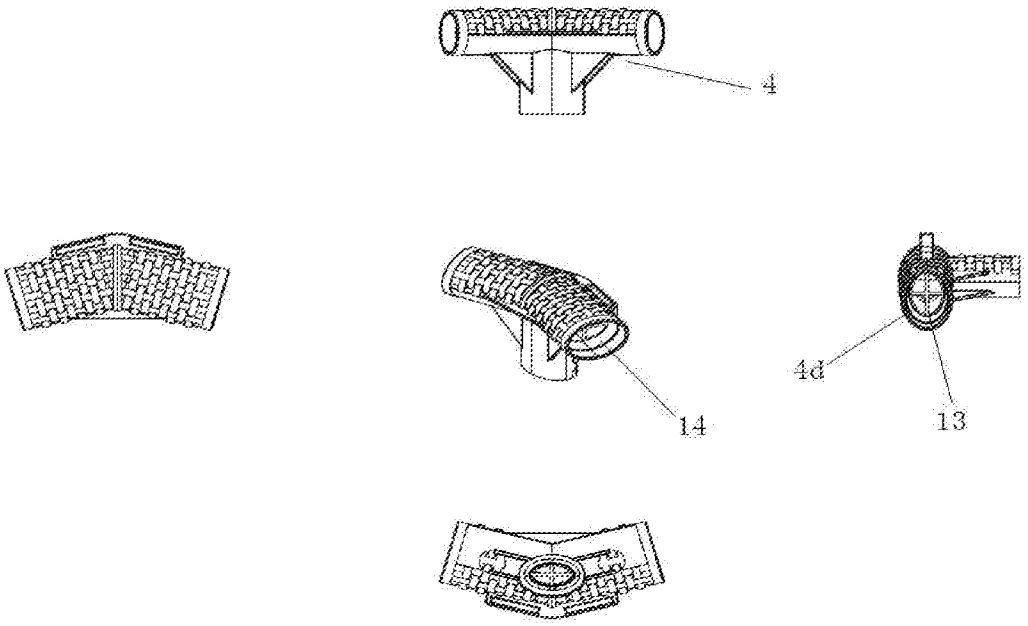
FIG. 4 is a perspective views of the connector of FIG. 3 in various directions.

FIG. 4 provides perspective views of the T-shaped connector 4 in different directions. The protruding parts 4*d* are disposed within the first and second tubular parts 4*a*, 4*b*, 4*c*, the cross-shaped reinforcing member 13 in the protruding parts 4*d*, and the projection(s) 14 can be clearly seen. The tubular parts 4*a*, 4*b*, 4*c* and the protruding parts 4*d* of the T-shaped connector 4 may be circular, elliptical, square, etc., and may be used for a pool of a circular shape, an elliptical shape, a square shape, etc.

Figure 5:
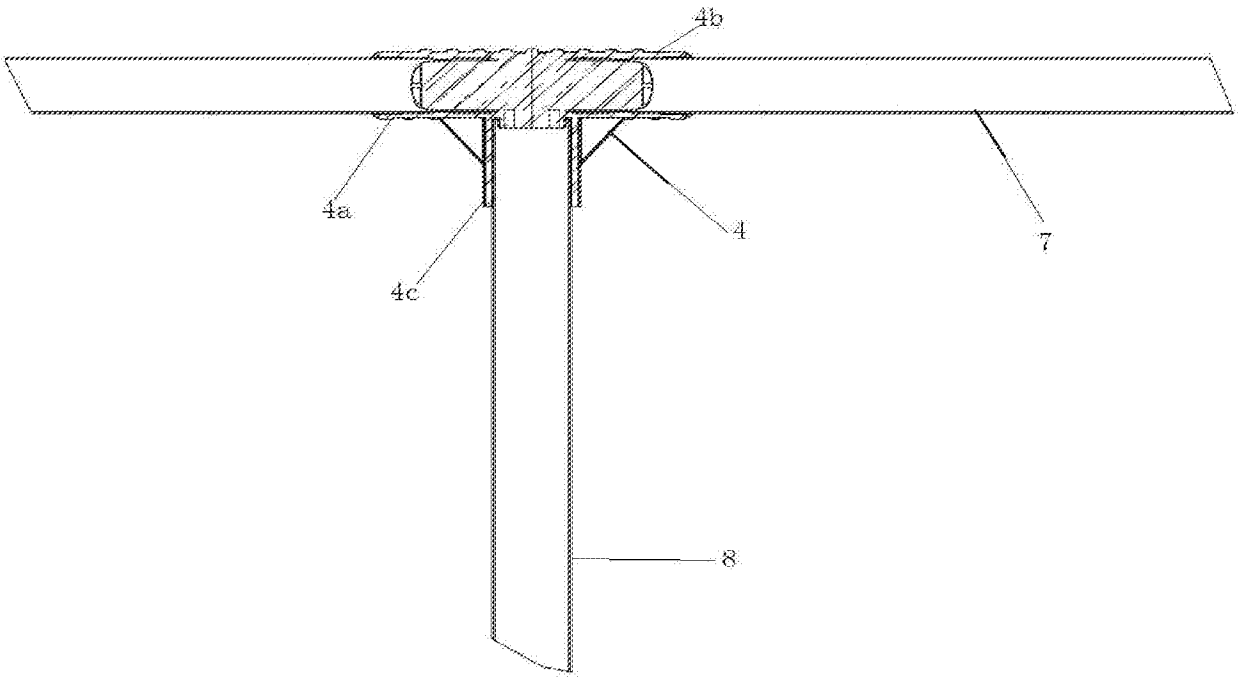
FIG. 5 is a cross-sectional assembled view of the connector in sealing engagement with a pair of first supporting tubes and a second supporting tube.

FIG. 5 is a cross-sectional view of the T-shaped connector 4 assembled with two first supporting tubes 7 and one second supporting tube 8. The two horizontal first supporting tubes 7 are inserted into the annular spaces 4*f* within the first tubular parts 4*a*, 4*b* of the T-shaped connector 4 and the second supporting tube 8 is inserted into the annular space 4*f* within the second tubular part 4*c*. The annular spaces 4*f* are designed such that the ends of each of the supporting tubes 7, 8 are press-fitted with a corresponding tubular parts 4*a*, 4*b*, 4*c*. In a preferred embodiment, the length of the protruding part 4*d* in the first tubular part 4*a*, 4*b* is greater than that of the protruding part 4*d* in the second tubular part 4*c*. However, it should be understood that the protruding part 4*d* in the first tubular part 4*a*, 4*b* may have a length less than or equal to that of the protruding part 4*d* in the second tubular part 4*c* without departing from the scope of the present invention. Optionally, no protruding parts may be provided inside the second tubular part 4*c*, and the end of the second supporting tube 8 may be directly inserted into the second tubular part 4*c* connecting with the T-shaped connector 4.

Figure 6:
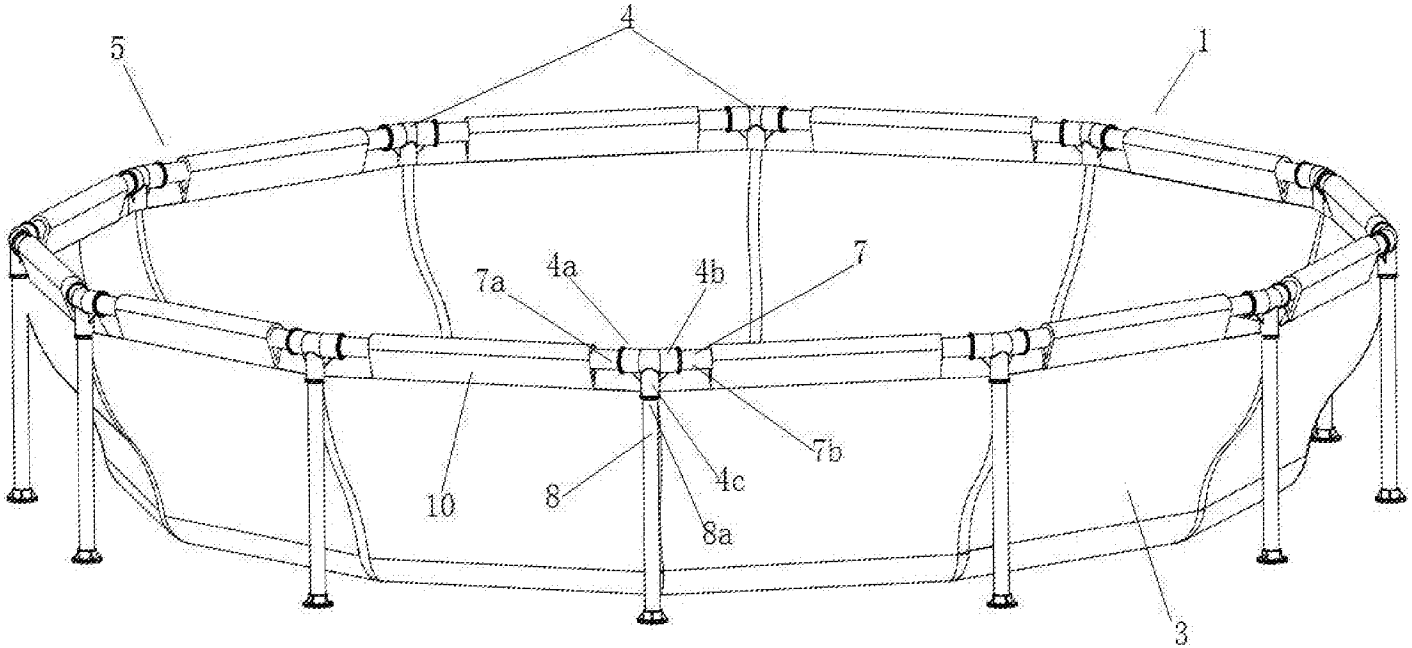
FIG. 6 is a perspective view of a framed pool constructed according a second embodiment of the present invention.
Figure 7:
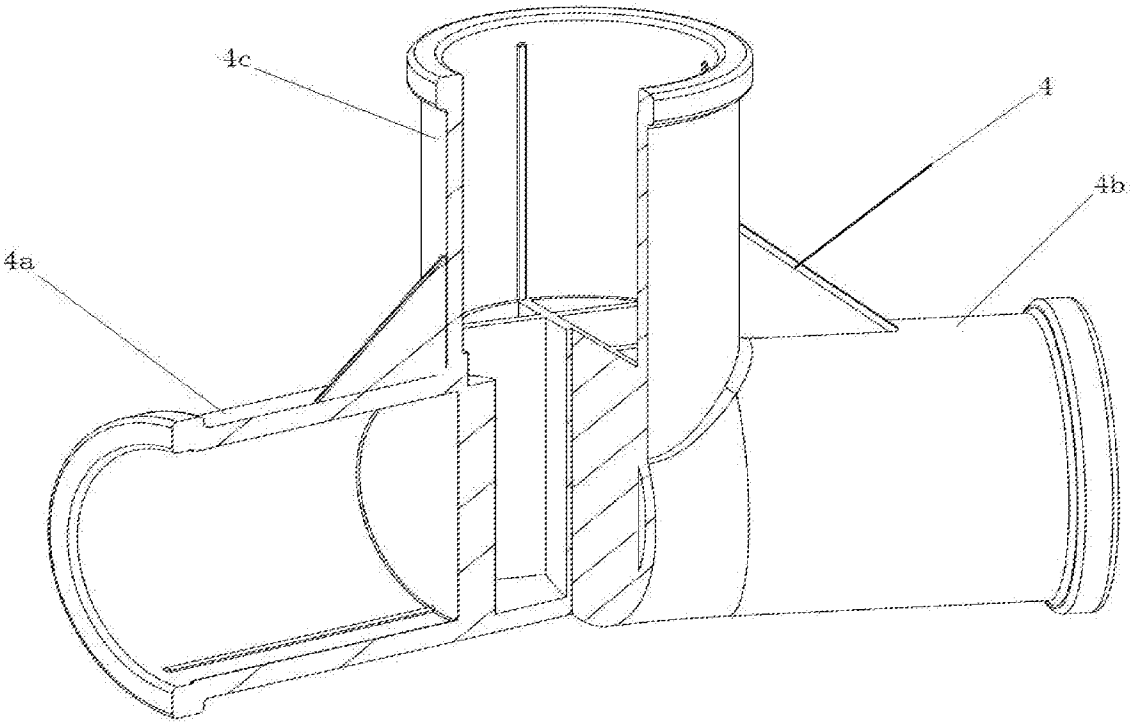
FIG. 7 is a sectional view of a connector of the bracket of FIG. 6.
Figure 8:
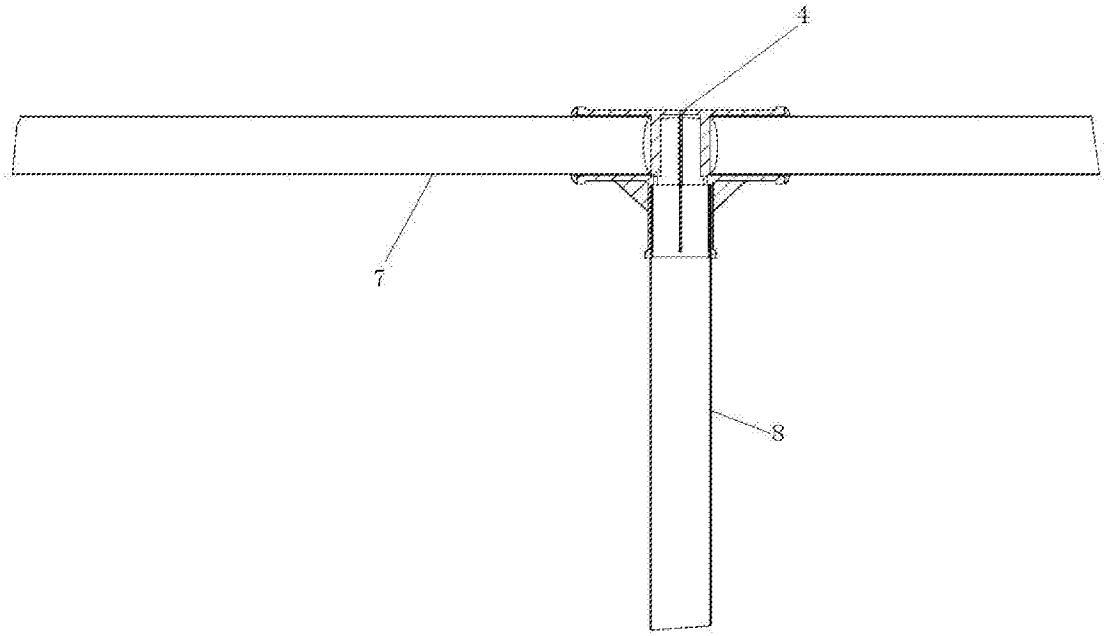
FIG. 8 is a cross-sectional assembled view of the connector of FIG. 7 in sealing engagement with a pair of first supporting tubes and a second supporting tube.

FIG. 6 shows a framed pool 1 according to a second embodiment of the present invention. The difference between the second embodiment and the first embodiment is as follows. In the first embodiment, a protruding part 4*d* is provided inside each of the first tubular parts 4*a*, 4*b* and the second tubular part 4*c* of the T-shaped connector 4 to form an annular space 4*f*. In the second embodiment, no protruding part 4*d* is provided inside the first tubular parts 4*a*, 4*b* and the second tubular part 4*c*. Upon assembly, the ends 7*a*, 7*b* of the first supporting tubes 7 are directly inserted into the first tubular parts 4*a*, 4*b* of the T-shaped connectors 4, and the ends 8*a* of the second supporting tubes 8 are directly inserted into the second tubular parts 4*c* of the T-shaped connectors 4.

In the first embodiment, the pool liner 3 abuts against the second supporting tubes 8 and is fixed to the second supporting tubes 8 by the reinforcing band 11. The pool liner 3 has a perimeter that is substantially equal to that of the upper frame 5. In the second embodiment, the pool liner 3 has a perimeter smaller than that of the upper frame 5. Because the perimeter of the pool liner 3 is smaller than that of the upper frame 5, after water is introduced into the framed pool 1, the weight of the water would apply a downward pulling force along the direction of the pool wall on the first supporting tubes 7 via the sleeves 10. Accordingly, the ends of the first supporting tubes 7 apply a pulling force in the same direction on the first tubular parts 4*a*, 4*b* of the T-shaped connectors 4. The first tubular parts 4*a*, 4*b* of the T-shaped connectors 4 provide reaction force in the opposite direction, so that the first tubular parts 4*a*, 4*b* of the T-shaped connectors 4 are press-fitted with the first supporting tubes 7 and it is difficult for the first supporting tubes 7 to be disengaged from the first tubular parts 4*a*, 4*b* of the T-shaped connectors 4. Thus, the arrangement forms a pinless connection between the connectors 4 and the first supporting tubes 7. In other words, by providing the annular spaces 4*f* in the T-shaped connectors 4, the first supporting tubes 7 can be press-fitted with the connectors 4. In addition, by making the perimeter of the pool liner 3*a* slightly smaller than that of the upper frame 5, the first supporting tubes 7 can be press-fitted with the connectors 4 due to the weight of the water after the water is introduced into the framed pool 1. Thus, the bracket 2 can be assembled without using any pins or other retention members, which reduces the number of fittings and installation steps, making it convenient to install and disassemble the bracket 2 and reduce the manufacturing cost.

Preferably, the perimeter of the pool liner 3 ranges from 7,000 mm to 24,000 mm. The perimeter of the upper frame 5 ranges from 7500 mm to 25000 mm. The height of each sleeve 10 ranges from 120 mm to 320 mm. The height of the pool wall 3*a* (including the sleeves 10) ranges from 500 mm to 1500 mm. The difference between the perimeters of the upper frame 5 and the pool liner 3 ranges from 500 mm to 1500 mm. A distance between axes of two adjacent second supporting tubes 8 ranges from 930 mm to 950 mm. The length of the sleeve 10 between two adjacent second supporting tubes 8 ranges from 900 mm to 930 mm. The height of the entire framed pool 1 ranges from 500 mm and 1500 mm.

The ratio of the perimeter of the pool wall 3*a* to the perimeter of the upper frame 5 ranges from 0.5 to 1, preferably from 0.8 to 1, and more preferably from 0.9 to 1. The height of the pool wall 3*a* (including the sleeves 10) is substantially equal to that of the bracket 2. The ratio of the length of each of the sleeves 10 to the distance between the central axes of two adjacent second supporting tubes 8 ranges from 0.5 to 1, preferably from 0.8 to 1, and more preferably from 0.9 to 1.

As shown in FIG. 6, the perimeter of the pool liner 3 is smaller than that of the upper frame 5. Accordingly, the pool wall 3*a* of the pool liner 3 does not completely abut against the second supporting tubes 8. Thus, no reinforcing band is necessary on the outer surface of the pool wall 3*a*.

It should be understood that, although the perimeter of the pool liner 3 is substantially equal to the upper frame 5 in the first embodiment, it is apparent that the perimeter of the pool liner 3 may also be smaller than that of the upper frame 5. Also, although no engaging structure such as protruding part is provided inside the tubular parts 4*a*, 4*b*, 4*c* of the T-shaped connectors 4 in the second embodiment, it is apparent that the engaging structure, e.g. the protruding parts 4*d*, may be provided. The features of the first embodiment and the second embodiment may be combined as desired without departing from the scope of the present invention.

Obviously, many modifications and variations of the present invention are possible in light of the above teachings and may be practiced otherwise than as specifically described while within the scope of the claimed invention. It is understood that all features descried and of all embodiments can be combined with each other, so long as such combination would not contradict one another.

What is claimed is:

1. A bracket for a frame pool, the bracket comprising:
a plurality of first supporting tubes;
a plurality of second supporting tubes; and
a plurality of connectors, each of said plurality of connectors connected to two adjacent first supporting tubes of said plurality of first supporting tubes via a press-fit connection and to one of said plurality of second supporting tubes, wherein each of said plurality of connectors has a T-shape and comprises:
a pair of first tubular part in sealing engagement with said two adjacent first supporting tubes;
a second tubular part in sealing engagement with said one of said plurality of second supporting tubes, said second tubular part being transverse to said pair of first tubular parts; and
a protruding part located in one of said pair of first tubular parts, said protruding part being radially spaced apart from an inner wall of said one of said pair of first tubular parts, thereby defining an annular space extending between said protruding part and said one of said pair of first tubular parts.

2. The bracket according to claim 1, wherein said annular space receives therein an end of one of said two adjacent first supporting tubes, thereby forming said press-fit connection.

3. The bracket according to claim 1, wherein each of said plurality of connectors further comprises a cross-shaped reinforcing member disposed within said protruding part.

4. The bracket according to claim 1, wherein said second tubular part has an inner wall and comprises at least one projection extending inward from said inner wall.

5. The bracket according to claim 4, wherein said at least one projection comprises a plurality of projections circumferentially spaced apart from one another and extending linearly along said inner wall of said second tubular part.

6. The bracket according to claim 1, further comprising a plurality of pads, each connected to a lower end of one of said plurality of second supporting tubes.

7. A bracket for a frame pool, the bracket comprising:
a plurality of first supporting tubes;
a plurality of second supporting tubes; and
a plurality of connectors, each of said plurality of connectors connected to two adjacent first supporting tubes of said plurality of first supporting tubes via a press-fit connection and to one of said plurality of second supporting tubes, wherein each of said plurality of connectors has a T-shape and comprises:
a pair of first tubular parts in sealing engagement with said two adjacent first supporting tubes; and
a second tubular part in sealing engagement with said one of said plurality of second supporting tubes, said second tubular part being transverse to said pair of first tubular parts;
wherein each of said first tubular parts has an inner wall and comprises at least one projection extending inward from said inner wall.

8. The bracket according to claim 7, wherein said at least one projection extends annularly from said inner wall.

9. The bracket according to claim 7, wherein said at least one projection extends linearly along said inner wall.

10. A bracket for a frame pool, the bracket comprising:
a plurality of first supporting tubes;
a plurality of second supporting tubes; and
a plurality of connectors, each of said plurality of connectors connected to two adjacent first supporting tubes of said plurality of first supporting tubes via a press-fit connection and to one of said plurality of second supporting tubes, wherein each of said plurality of connectors has a T-shape and comprises:
a pair of first tubular parts in sealing engagement with said two adjacent first supporting tubes;
a second tubular part in sealing engagement with said one of said plurality of second supporting tubes, said second tubular part being transverse to said pair of first tubular parts; and
a protruding part located in said second tubular part, said protruding part being radially spaced apart from an inner wall of said second tubular part, thereby defining an annular space extending between said protruding part and said second tubular part.

11. A frame pool comprising:
a pool liner; and
a bracket supporting said pool liner and comprising:
a plurality of first supporting tubes;
a plurality of second supporting tubes; and
a plurality of connectors, each of said plurality of connectors connected to two adjacent first supporting tubes of said plurality of first supporting tubes via a press-fit connection and to one of said plurality of second supporting tubes;
said pool liner comprising:
a pool wall having a lower edge and an upper edge; and
a pool bottom having a periphery;
said lower edge of said pool wall being connected to said periphery of said pool bottom; and
a plurality of sleeves located at said upper edge of said pool wall, each sleeve of said plurality of sleeves receiving therein one of said plurality of first supporting tubes, and adjacent ones of said plurality of sleeves being spaced apart from one another thereby exposing one of said plurality of connectors therebetween;
wherein each of said plurality of connectors has a T-shape and comprises:
a pair of first tubular parts in sealing engagement with two adjacent first supporting tubes;
a second tubular part in sealing engagement with said second supporting tube, said second tubular part being transverse to said pair of first tubular parts; and
a protruding part located in one of said pair of first tubular parts, said protruding part being radially spaced apart from an inner wall of said one of said pair of first tubular parts, thereby defining an annular space extending between said protruding part and said one of said pair of first tubular parts.

12. The frame pool according to claim 11, wherein said annular space receives therein an end of one of said two adjacent first supporting tubes, thereby forming said press-fit connection.

13. The frame pool according to claim 11, wherein each of said plurality of connectors further comprises a cross-shaped reinforcing member disposed within said protruding part.

14. The frame pool according to claim 11, wherein each of said first tubular parts has an inner wall and comprises at least one projection extending inward from said inner wall.

15. The frame pool according to claim 14, wherein said at least one projection extends annularly from said inner wall.

16. The frame pool according to claim 14, wherein said at least one projection extends linearly along said inner wall.

17. A frame pool comprising:

a pool liner; and a bracket supporting said pool liner and comprising:

a plurality of first supporting tubes;

a plurality of second supporting tubes; and a plurality of connectors, each of said plurality of connectors connected to two adjacent first supporting tubes of said plurality of first supporting tubes via a press-fit connection and to one of said plurality of second supporting tubes;

said pool liner comprising:

a pool wall having a lower edge and an upper edge; and a pool bottom having periphery;

said lower edge of said pool wall being connected to said periphery of said pool bottom; and a plurality of sleeves located at said upper edge of said pool wall, each sleeve of said plurality of sleeves receiving therein one of said plurality of first supporting tubes, and adjacent ones of said plurality of sleeves being spaced apart from one another thereby exposing one of said plurality of connectors therebetween;

wherein each of said plurality of connectors has a T-shape and comprises:

a pair of first tubular parts in sealing engagement with two adjacent first supporting tubes;

a second tubular part in sealing engagement with said second supporting tube, said second tubular part being transverse to said pair of first tubular parts; and a protruding part located in said second tubular part, said protruding part being radially spaced apart from an inner wall of said second tubular part, thereby defining an annular space extending between said protruding part and said second tubular part.

18. The frame pool according to claim 17, further comprising a plurality of pads, each connected to a lower end of one of said plurality of second supporting tubes.

19. The frame pool according to claim 17 wherein said pool wall has a perimeter less than or equal to a perimeter of an upper frame comprising said plurality of first supporting tubes.

20. The frame pool according to claim 19, wherein a ratio of said perimeter of said pool wall to said perimeter of said upper frame ranges from 0.5 to 1.

21. The frame pool according to claim 19, wherein a ratio of said perimeter of said pool wall to said perimeter of said upper frame ranges from 0.8 to 1.

22. The frame pool according to claim 21, wherein a ratio of said perimeter of said pool wall to said perimeter of said upper frame ranges from 0.9 to 1.

23. The frame pool according to claim 17, further comprising a reinforcing band extending around an outer surface of said pool wall and said plurality of second supporting tubes.

24. The frame pool according to claim 23, further comprising a plurality of fixing patches, each attaching said reinforcing band to said outer surface of said pool wall.

25. The frame pool according to claim 19, wherein said perimeter of said upper frame ranges from 5000 mm to 30,000 mm.

26. The frame pool according to claim 19, wherein said perimeter of said pool wall ranges from 5000 mm to 30,000 mm.

27. The frame pool according to claim 19, wherein a difference between said perimeter of said upper frame and said perimeter of said pool wall ranges from 0 to 1000 mm.

* * * * *